United States Patent [19]

Long et al.

[11] Patent Number: 5,072,709

[45] Date of Patent: Dec. 17, 1991

[54] FUEL INJECTION FOR AN INTERNAL COMBUSTION ENGINE

[75] Inventors: Martin W. Long, Columbus, Ind.; Charles B. Fry, Columbus, Ind.; David M. Rix, Columbus, Ind.; Raul Krivoy, Beaverton, Oreg.

[73] Assignee: Cummins Engine Co., Inc., Columbus, Ind.

[21] Appl. No.: 501,022

[22] Filed: Mar. 29, 1990

[51] Int. Cl.[5] ..... F02M 59/02

[52] U.S. Cl. ..... 123/446; 123/501; 239/89

[58] Field of Search ..... 123/446, 447, 500, 501, 123/508; 239/88, 89, 90, 91, 92, 93, 94, 95, 96, 533.1–533.12

[56] References Cited

U.S. PATENT DOCUMENTS

| | | | |
|---|---|---|---|
| 1,511,484 | 10/1924 | Peterson | 239/88 |
| 2,590,575 | 8/1945 | Rogers | 239/88 |
| 2,997,994 | 8/1961 | Falberg | 123/447 |
| 3,217,780 | 11/1965 | Cremer et al. | 431/1 |
| 4,281,792 | 8/1981 | Sisson et al. | 239/5 |
| 4,306,681 | 12/1981 | Laitio et al. | 239/89 |
| 4,378,774 | 4/1983 | Kato | 123/495 |
| 4,394,963 | 7/1983 | Iwata | 239/89 |
| 4,463,725 | 8/1984 | Laufer et al. | 123/446 |
| 4,475,515 | 10/1984 | Mowbray | 123/467 |
| 4,531,672 | 7/1985 | Smith | 239/89 |
| 4,537,352 | 8/1985 | Kato | 123/446 |
| 4,669,659 | 6/1987 | LeBlanc | 239/95 |
| 4,811,899 | 3/1989 | Egler | 239/93 |
| 4,846,114 | 7/1989 | List | 123/26 |

OTHER PUBLICATIONS

Ronald B. Lannan, Albert E. Sisson and William G. Wolber, entitled: "Cummins Electronic Controls for Heavy Duty Diesel Engines", Published in International Congress on Transportation Electronics Proceedings, Oct. 17–18, 1988, Library of Congress Catalog Card Number 87-83470.

*Primary Examiner*—Carl Stuart Miller
*Assistant Examiner*—Erick Solis
*Attorney, Agent, or Firm*—Neuman, Williams, Anderson & Olson

[57] ABSTRACT

A mechanically pressurized electronic fuel injector is for use in internal combustion engines and is actuated by the engine valve train. The fuel injector has an injection stroke for discharging fuel into the engine and a metering stroke for receiving a predetermined volume of fuel in the injector. During the injection stroke, a coupling member contacts a timing plunger and transmits a compressive force from the engine valve train. The coupling member and the timing plunger are not mechanically connected together and are capable of independent relative movement. During the metering stroke of the injector, the timing plunger is returned to its pre-injection position under the pressure generated by the fuel entering the timing and metering plunger chambers.

6 Claims, 1 Drawing Sheet

FUEL INJECTION FOR AN INTERNAL COMBUSTION ENGINE

FIELD OF THE INVENTION

The present invention relates to fuel injectors for an internal combustion engine and more specifically to a high pressure electronic fuel injector in which the internal moving parts are capable of independent relative movement.

BACKGROUND OF INVENTION

Electronic fuel injectors are frequently used in today's internal combustion engines. The electronic fuel injector provides precise and reliable fuel delivery into the cylinder of compression ignition and spark ignition engines. The precision and reliability of the electronic fuel injector have contributed to the goals of fuel efficiency, maximum practicable power output and control of undesirable products of combustion. These and other benefits of electronic fuel injection systems are well known and are appropriately used to beneficial effect in the design of modern internal combustion engines.

Known electronic fuel injectors, especially those designed for application in spark ignition or compression ignition engines, utilize mechanical means to enhance fuel charge pressurization. Enhanced fuel charge pressurization is desirable during the fuel injection event to assure proper atomization and spray distribution of the fuel into the engine cylinder or pre-chamber. In addition, it is desirable to be able to determine the quantity of fuel used and to control the injection timing for several reasons, including obtaining full combustion of the fuel to control particulate emissions. This has been of great interest in recent years, owing to environment concerns and regulatory incentives. Finally, the proper control of fuel injectors reduces the amount of residual particulate formed in the compression ignition engine cylinder.

Several known types of fuel injectors include a means for the mechanical pressurization of the fuel charge. These fuel injectors have mechanical linkage systems coupled to the engine camshaft and/or cylinder head valve train assembly. Such fuel injectors are configured so that the camshaft or other rotating or reciprocating member acts on an injector link or equivalent structure either directly or indirectly through a rocker arm.

The injector link is generally vertically oriented with respect to the injector. Typically, displacement of the link in the downward direction (along the vertical axis) also causes an injector coupling to move downward within a bore created in the injector body. The coupling is spring-loaded and is returned to its original position by the force of a coupling return spring. The injector coupling is attached to a timing plunger and movement of the coupling causes relative movement of the timing plunger. When the injector coupling moves downward, the timing plunger moves downward into a timing plunger chamber. The timing plunger chamber, filled with fuel at the original fuel rail pressure of 150 psi, is maintained at this pressure for a portion of the injection stroke by allowing fuel to escape from the timing plunger chamber through a passage leading to a control valve. At a predetermined crank shaft angle occurring during the injection stroke, identified by well established methods, a control solenoid causes the control valve to close. Pressure is then increased in the timing plunger chamber and the control valve passage as a result of fuel compression by the downward motion of the timing plunger. This pressure creates a force acting upon a metering plunger, which then acts upon a closed metering chamber pre-filled with an appropriate volume of fuel. Thus, the pressure of the fuel charge already metered into the metering plunger chamber of the injector is increased. The pressure increase caused by the metering plunger, at a predetermined pressure, causes the injector nozzle to open and fuel then exits the injector. The injection or down stroke action of the injector coupling within the injector body insulates the timing and metering plunger from any undesirable side loads that may be transmitted from the valve train of the engine.

The upward or metering stroke of the injector coupling and accordingly the timing plunger is generally accomplished by the use of the return spring force acting on the injector coupling. The attachment of the timing plunger to the injector coupling is usually accomplished by a "T slot" arrangement, however, any method of physically joining the coupling to the timing plunger can be used. In such a physical connection arrangement, the top of the timing plunger is formed with a wide head sitting atop a narrow neck, and the bottom of the injector coupling is formed with a compatible receiving cavity to the top of the timing plunger. Thus, when the injector coupling is urged upward by the force of the return spring at the speed allowed by the withdrawal of the link and camshaft assembly, the timing plunger is drawn upward. The "T slot" interface transmits force from the coupling member to the timing plunger in both axial directions along the central axis of the injector body. A fresh fuel charge is then sequentially allowed to flow into the metering and timing plunger chamber by the control valve, to await the next engine cycle.

Several drawbacks exist in the fuel injector using the physically connected coupling/timing plunger combination described above. First, if the timing plunger for any reason binds or seizes within the bore of the injector body, the injector coupling becomes immobilized. In this situation, since the injector coupling, through the coupling return spring, also provides a restoring force to the link to ensure constant link contact with the camshaft, the link also becomes immobilized. Thus, a gap occurs between the camshaft and link interface. This gap, under some circumstances, causes the valve train to become imbalanced and vibrate at unpredictable and undesirable amplitudes and frequencies, especially at high engine speed and low load operating conditions, as the push rod is no longer balancing the loads on the valve train. Even more seriously, this gap can dislodge the push rod and allow the push rod to become a detached body within the valve train and cylinder head assembly, possibly resulting in significant and irreparable cylinder head and engine block damage.

Second, the "T-slot" configuration requires very close tolerances to ensure proper fit and function. The use of close tolerances is costly due to the complicated machining required. If the coupling/timing plunger interface or the "T slot" interface is out of tolerance, then timing plunger scuffing and seizing occurs, due to unpredictable and undesirable side loading.

Finally, the timing plunger's upward motion, due to the high change rate of the camshaft profile ultimately acting upon the push rod and mechanically attached coupling member can be extremely rapid at high engine RPM. This rapid motion can exceed the ability of the fuel injection supply device to provide fuel to the metering plunger chamber. Should this occur, cavitation results causing pressure fluctuation during the injection event and errors in the fuel mass injected.

SUMMARY OF THE INVENTION

The above problems are solved in a mechanically pressurized electronic fuel injector of the type described above by eliminating the positive mechanical linkage interconnection between the coupling and the timing plunger. By eliminating the "T slot" interface completely, only surface to surface contact between the injector coupling and the timing plunger is present during the injection event or cycle. After the injection event the injector coupling is returned to its original position under the force from the coupling return spring. The timing plunger, which is not physically connected to the injector coupling, is then free to return to its original position as a result of the pressure generated by the fuel entering the timing and metering plunger chambers. Thus, a simplified, more reliable and effective fuel injector is described satisfying the greater demands of modern spark ignition and compression ignition engines.

The above, and other related features of the present invention will be apparent from a reading of the following description of the drawings and the appended claims.

DETAILED DESCRIPTION OF THE DRAWINGS

Figure 1:
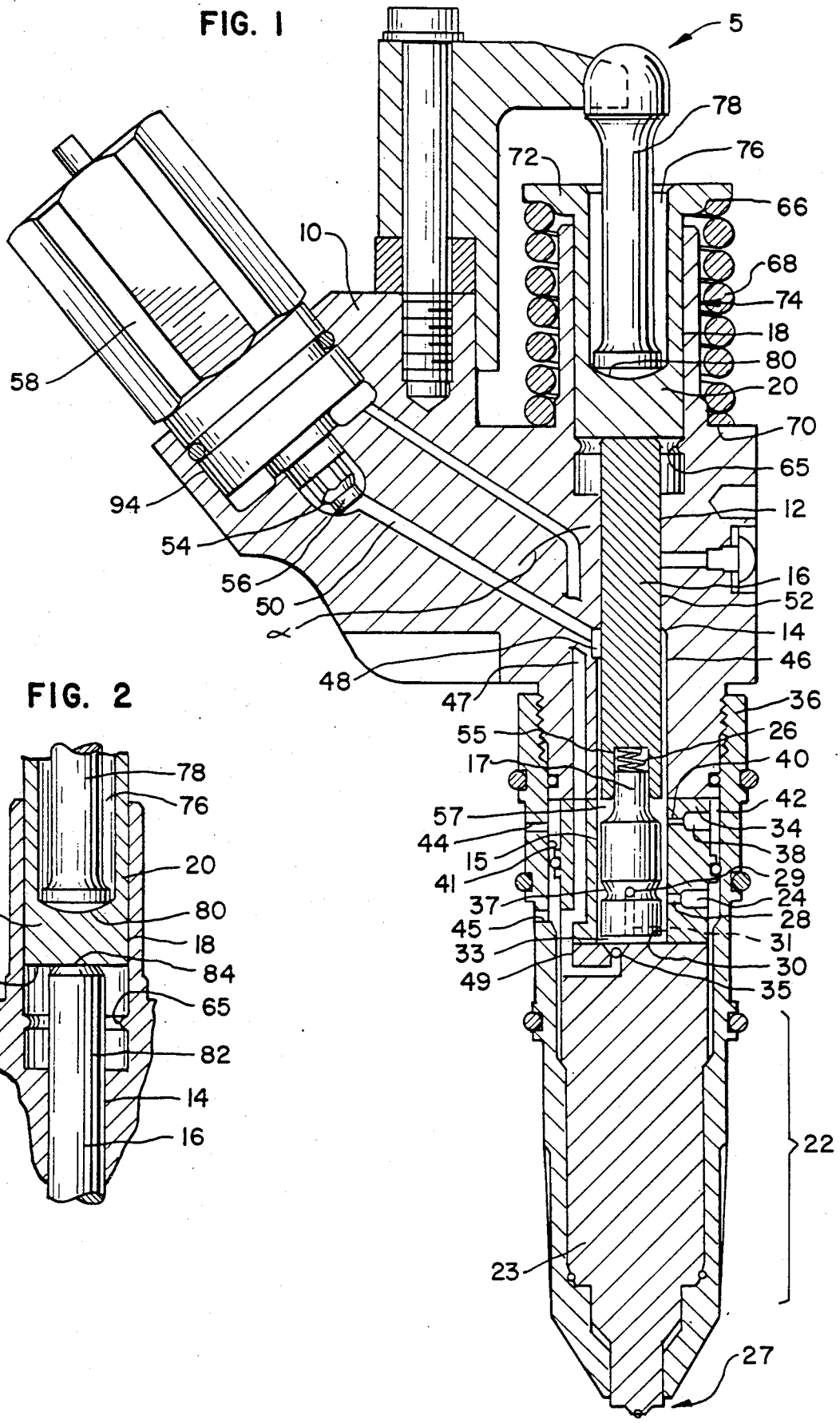
FIG. 1 is a cross-sectional view of a high pressure electronic fuel injector constructed according to the present invention.

Referring to the drawings, wherein reference characters designate like or corresponding parts throughout the views, FIG. 1 illustrates the overall configuration of the mechanically assisted electronic fuel injection assembly 5. The injector body 10 is formed preferably as a forged unit, and a central axial cavity 12 extends throughout the length of the injector body 10. The axial cavity 12 is actually comprised of two coaxial and communicating central cylindrical bores of differing inner diameters. The first cylindrical bore 14 is provided in the injector body 10 and slidingly receives timing plunger 16. The second cylindrical bore 18 slidingly receives coupling member 20. The cylindrical bores 14 and 18 are illustrated in the collapsed state. A metering plunger 17 is slidingly received in central cylindrical bore 15 formed in metering barrel 34.

A metering spill orifice 28 is provided within the metering barrel 34 and allows selective passage of fuel ultimately between the metering plunger chamber 33 and the typical fuel rail (not shown) which extends across the cylinder and allows the passage of fuel from a tank or storage vessel to the injector. The metering spill port orifice 28 and a metering spill port 24 are located on the side wall 30 of the metering barrel 34. The metering barrel 34 is also provided with timing spill orifice 40, located on the side wall 30 of the metering barrel 34, and timing spill port 38 which allow selective fuel transportation between a timing plunger chamber 26, timing spill edge 57, timing spill port 38 and return channel 42. The return channel 42, forming an annular cavity on the interior surface 41 of the nozzle retainer 36, is in communication with return port 44 and the typical fuel return circuit (not shown) directing fuel back to the fuel tank under low pressure.

Fuel is provided to the metering plunger chamber 33 and the control chamber 54 via fuel inlet port 45, control valve fuel inlet passage 47 and metering fuel inlet passage 49. Fuel flows selectively through the inlet passage 49 into the metering plunger chamber 33 through check ball 35. Fuel also flows through the inlet passage 47 to control chamber 54 for selective flow ultimately to the timing plunger chamber 26 through control valve 56. Fuel is provided to the timing plunger chamber 26 via the timing plunger central passage 46, which extends as an annular passage formed between the central cylindrical bore 14 and the timing plunger 16. Passage 46 is in further communication with control orifice 48 located on the side wall 52 of the first cylindrical central bore 14. The control orifice 48 provides communication to control passage 50, which in turn is in selective communication with control chamber 54 via control valve assembly 56. The valve assembly 56 is directly controlled by control solenoid 58 in a manner which is well known. The inclined or angular position of the control solenoid 58 with respect to the central axis of the injector body 10 allows the control passage 50 to be drilled or machined through the boss or opening 94 in the injector body 10 which receives the control solenoid 58. This structure eliminates the need for additional drilling or machining orifices in the external surface of injector body 10, which must be subsequently sealed with high pressure plugs.

In its downward or injection stroke position, the timing plunger 16 protrudes into the lower or base portion of the second central cylindrical bore 18 but is not mechanically coupled to the coupling member 20. The coupling member 20 abuts with the timing plunger 16 and only a compressive load is transferred from the coupling member 20 to the timing plunger 16.

The coupling member 20 is equipped with an annular stop 65, located at the bottom end of the coupling member 20. The stop 65 limits the translation or movement of the coupling member 20 in the direction of the injection stroke. Extending further radially outward on the flange 72 of the coupling member 20 is spring seat 66, through which return spring 68 acts upon the coupling member 20 so as to bias the coupling member 20 in the direction of the upward or metering stroke. The opposite end of the return spring 68 acts upon spring seat 70, located on the injector body 10 at a base of the collar 74.

At the exposed end of the coupling member 20, pocket 76 and bearing surface 80 are formed, which allow link 78 to transmit a force upon the coupling member 20 against the force created by the return spring 68 during the injection stroke. Link 78 functions in a well known fashion and is in typical contact with the valve train camshaft (not shown) and reciprocates along the central axis of injector assembly 5 in response to the angular position of the actuating cam (not shown). Thus, rotational motion of the camshaft is converted into reciprocal motion of the injector assembly 5 axial components so as to provide force useful in pressurizing the timing plunger chamber 26 and metering chamber 33.

The operation of the injector assembly 5 requires fuel to be supplied via the control valve 56, passage 50, orifice 48 and channel 46 to the timing plunger chamber 26 and via metering fuel inlet passage 49 and check ball 35 to the metering plunger chamber 33 at a predetermined delivery fuel pressure of 150 psi. Immediately prior to the initiation of the injection stroke, the control valve 56 is open, the metering chamber 33 has been filled to the predetermined volume of fuel at 150 psi via the passage 49 and the check valve 35, the timing plunger chamber 26 has been filled with a balancing fuel at 150 psi via control valve 56, passage 50, orifice 48 and passage 46, and the metering plunger 17 is suspended in place between the metering chamber 33 and timing plunger chamber 26. As the control valve 56 is open, fuel flow is allowed back from the timing plunger chamber 26 through passage 46, orifice 48, passage 50 and control valve 56 ultimately into the fuel rail system, thereby allowing a constant pressure in the timing plunger chamber 26 to be maintained by pre-injection backflow.

As the injection cycle begins, the valve train cam acts on the link 78 to displace it toward the coupling member 20. In response, the coupling member 20 contacts the timing plunger 16 with a compressive force and displaces the timing plunger 16 into the timing plunger chamber 26 and causes pre-injection backflow of fuel as described above as timing plunger 16 begins to displace fuel in timing plunger chamber 26. The return spring 68 is simultaneously compressed and a restoring force is generated against the coupling member 20.

As the timing plunger 16 continues its travel, a signal is sent to control solenoid 58 at a predetermined crankshaft angle as is well known in the art causing the control valve 56 to close. With the control valve 56 closed, fuel is no longer allowed to flow out of the timing plunger chamber 26, through orifice 48, passage 50 and control valve 56 into control chamber 54, and ultimately through passage 47 and port 45 back to the fuel rail. Thus, pre-injection backflow is terminated and the metering plunger 17 is no longer suspended in place. Also, closing the control valve 56 causes the pressure in the timing plunger chamber 26 to increase, creating a hydraulic link in the timing plunger chamber 26 and a force upon the metering plunger 17, which tends to increase the pressure in the metering chamber 33. Pressurization increases until about 5000 psi is reached in both chambers. When 5000 psi is reached, communication via well known means is established with nozzle 27 and injection is initiated. Initially, the nozzle 27 flow is low at 5000 psi. Thereafter, the timing plunger chamber 26 and metering plunger chamber 33 pressures continue to increase, generally to about 20,000 psi (although transient pressures of 23,500 psi are not uncommon). Injection continues under the high pressures until the end of the injection stroke is reached.

At the completion of the injection stroke, the timing spill edge 57 and metering spill edge 37, located on the metering plunger 17, pass over timing spill orifice 40 and metering spill orifice 28. The metering plunger 17 is further provided with metering passage 31, which provides communication between metering spill port 24 and metering plunger chamber 33. Thus, as the spill channels coincide with the spill orifices, the pressure residual existing in the two chambers is relieved.

After the injection event, the valve train camshaft continues its rotation and the cam allows link 78 to move away from the coupling member 20. The coupling member 20 and the link 78 are then urged to follow the cam profile due to the force generated in the compressed return spring 68 acting on the coupling member 20 through spring seat 66 and flange 72. Since the timing plunger 16 is not physically connected to the coupling member 20, as the coupling member 20 is urged upward, in a generally vertical direction away from the nozzle assembly 22 of the injector assembly 5, the timing plunger 16 is not forced to follow the coupling member 20. The timing plunger 16 is free to translate or move independently of the coupling member 20.

The timing plunger 16 is urged toward the coupling member 20 against gravity only by the pressure of the fuel delivered to the metering plunger chamber 33 at the fuel rail pressure of 150 psi. The pressure existing in the fixed volume of the timing plunger chamber 26 is increased by metering plunger chamber 33 pressure acting on the lower surface area of the metering plunger 17 defining a portion of the metering plunger chamber 33. The pressure increase in the fixed volume of the timing plunger chamber 26 acts on the lower surface area of the timing plunger. Thus, the timing plunger 16 is urged to move in a upward or vertical direction to maintain contact with the coupling member 20. Metering check ball 35, located on the surface of nozzle spacer 23 exposed to the metering plunger chamber 33, opens to a slight gap between the metering barrel 34 and the nozzle spacer 23. This gap allows incoming fuel at the fuel rail pressure of 150 psi to enter and expand metering plunger chamber 33. Thus, the metering plunger 17 is urged to maintain contact by hydraulic pressures within timing plunger 16 and the timing plunger 16 is caused to move upward through the injector body by the pressure of the fuel delivered into the timing plunger chamber 26 and metering plunger chamber 33.

As the coupling member 20 and the timing plunger 16 continue their respective and independent upward motion, control valve 56, which has been closed for a portion of the injection stroke, is caused to open by the actuation of control solenoid 58. The timing of the opening of control valve 56 is established by the quantity of desired fuel allowed into the metering plunger chamber 33. Once control valve 56 is opened, fuel flow at the fuel rail pressure of 150 psi is allowed into timing plunger chamber 26. As the fuel pressure in both the metering plunger chamber 33 and the timing plunger chamber 26 is equal, the pressure forces acting on metering plunger 17 in both the upward and downward axial direction are balanced and motion of the metering plunger 17 ceases. A very low spring rate bias spring 55 is provided between the opposing surfaces of the two plungers and within the timing plunger chamber 26 so as to counteract the inertial effects of the motion of the metering plunger 17 and bring the metering plunger to a full and precise stop. Thus, a precise and metered volume of fuel is admitted into the metering plunger chamber 33 and maintained during the remainder of the metering stroke. Spring 55 also tends to induce a slight pressure on metering chamber 33 through metering plunger 17 and thus encourages check ball 35 to fully seat and seal chamber 33. The timing plunger 16 continues to move upward independently of the coupling member 20 away from the now suspended metering plunger 17 under the force of the fuel pressure entering the plunger chamber 26. The volume of timing plunger chamber 26 thus increases as it is filled with fuel at the fuel rail pressure of 150 psi. After the top of the metering stroke is reached, another injection stroke begins as explained above.

Figure 2:
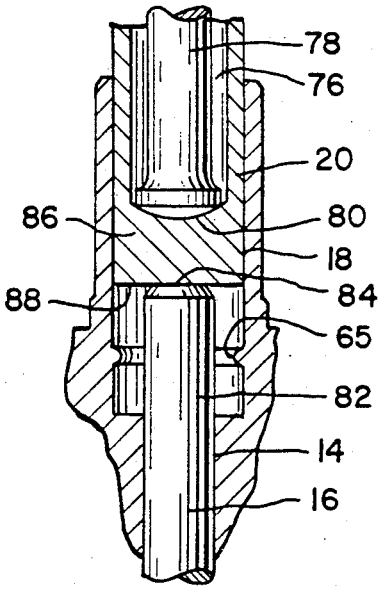
FIG. 2 is a detailed view of the interface between the injector coupling and the timing plunger of the high pressure electronic fuel injector according to the present invention.

FIG. 2 illustrates the detail of the interface between the coupling member 20 and the timing plunger 16. The distal end 82 of the timing plunger 16, which protrudes into the second central cylindrical bore 18, has a substantially flat surface or face 84, with a slight camfer. The flat surface is circular and lies in a plane which is perpendicular to the central axis of the timing plunger 16. The distal end 86 of the coupling member 20 has a substantially flat surface or face 88. The flat surface 88 is circular and lies in a plane which is perpendicular to the central axis of the coupling member 20. The flat surface 84 of the timing plunger 16 abuts but is not physically connected to the flat surface 88 of the coupling member 20. The flat surface 84 and the flat surface 88 form parallel abutting surfaces capable of transmitting only compressive, not tensile, loads.

In FIG. 2, the interface between coupling member 20 and timing plunger 16 is illustrated as being between two substantially flat surfaces 84 and 88. The distal end 82 of the timing plunger 16 can be any other geometric shape such as a sphere and the distal end 84 of the coupling member 20 can be any other geometric shape, such as a sphere. The distal end 82 and the distal end 84 can be symmetrical or asymmetrical The distal ends 82 and 84 can be any geometric shape provided that at their interface substantially only compressive forces are transferred and that they are not physically joined together.

Unlike injector assemblies employing a configuration similar to the "T slot" interface, the injector assembly 5 according to this invention has decoupled the motion of the coupling member 20 and timing plunger 16. Binding or seizing of the timing plunger 16 does not influence the operation of the coupling member 20 and the link 78. Thus, valve train imbalances and dislodgement of the link 78 are avoided. Further, scuffing or seizing of the timing plunger 16 caused by side loading occurring in the "T slot" interface is not possible since the faces 84 and 88 are incapable of transmitting side loads. Finally, the timing plunger 16 is urged toward the coupling member 20 during the metering stroke only by the fuel pressure existing in the timing plunger chamber 26. Thus cavitation and the negative influences of cavitation in the timing plunger chamber 26 does not occur.

A preferred embodiment of the present invention has been described, however, it is not intended to limit its spirit and scope. It will be understood that various changes in the details, arrangements and configuration of the parts which have been described and illustrated above in order to explain the nature of the present invention may be made by those skilled in the art within the principle and scope of the present invention as expressed in the appended claims.

What is claimed is:

1. A fuel injector for use in an internal combustion engine comprising:

an injector body having a first cylindrical bore and a second cylindrical bore, said second cylindrical bore being coaxially positioned relative to and in communication with said first cylindrical bore;

control means for metering a predetermined volume of fuel at high pressure;

a metering barrel having a metering chamber for receiving said predetermined volume of fuel at high pressure, said metering barrel being connected to said injector body;

a timing plunger chamber forming part of said second cylindrical bore and being in continuous fluid communication with said control means for metering said predetermined volume of fuel;

a timing plunger adapted for movement within said timing plunger chamber;

a coupling member adapted for movement within said first cylindrical bore;

said coupling member and said timing plunger being in abutting relationship and being free to move independently within said first cylindrical bore and said second cylindrical bore respectively, said timing plunger motion being controlled by said control means to meter said predetermined volume of fuel; and an injection nozzle in communication with said metering plunger chamber for delivering said predetermined volume of fuel into said engine.

2. The fuel injector as set forth in claim 1, wherein said timing plunger has a first and second end, said first end of said timing plunger having a substantially flat surface;

said coupling member has a first and second end, said second end of said coupling member having a substantially flat surface; and said flat surface of said first end of said timing plunger being in abutting relationship with said flat surface of said second end of said coupling member for transferring compressive forces.

3. The fuel injector as set forth in claim 1, further comprising a return means connected to said coupling member to bias said coupling member upward out of said first cylindrical bore.

4. The fuel injector of claim 3, said injector further comprising a return means connected to said coupling member wherein said timing plunger chamber receives fuel according to said control means to meter said predetermined volume of fuel and to exert a pressure contained therein upon said timing plunger to move said timing plunger toward said coupling member in response to said pressure;

said return means biasing only said coupling member to move upward out of said first cylindrical bore and allowing independent motion of said timing plunger and said coupling member upwardly within said injector.

5. A fuel injector having an injection stroke and a metering stroke for use in an internal combustion engine, said injector comprising:

an injector body having a first cylindrical bore and a second cylindrical bore, said second cylindrical bore being coaxially positioned relative to and in communication with said first cylindrical bore;

control means for metering a predetermined volume of fuel at high pressure;

a metering barrel having a metering chamber for receiving a predetermined volume of fuel at high pressure, said metering barrel being connected to said injector body;

a coupling member adapted for downward movement within said first cylindrical bore during the injection stroke of said injector;

a timing plunger chamber forming part of said second cylindrical bore;

a timing plunger adapted for movement within said timing plunger chamber during the injection stroke of said injector, said timing plunger having a surface exposed to said timing plunger chamber;

said timing plunger chamber being in continuous fluid communication with said control means for metering said predetermined volume of fuel;

said coupling member contacting said timing plunger for transferring compressive forces during the injection stroke of said injector;

an injection nozzle in communication with said metering chamber for delivering said predetermined volume of fuel into said engine during the completion of the injection stroke of said injector;

a return means connected to said coupling member to bias only said coupling member for upward movement within said first cylindrical bore during the metering stroke of said injector;

said timing plunger motion during said metering stroke being controlled only by said control means;

said coupling member moving independently relative to said timing plunger according to said high fuel pressure contained within said timing plunger chamber exerting pressure on said surface of said timing plunger during the metering stroke of said injector; and said control means delivering fuel into said timing plunger chamber to independently move said timing plunger upward in said timing plunger chamber relative to said coupling means until the completion of the metering stroke of said injector.

6. The fuel injector as set forth in claim 2, further comprising a return spring connected to said coupling member to bias said coupling member upward out of said first cylindrical bore; and said timing plunger chamber receiving high pressure fuel according to said control means to meter said predetermined volume of fuel and to exert a pressure contained therein upon said timing plunger to move said timing plunger toward said coupling member in response to said pressure.

* * * * *